US008534211B2

(12) United States Patent
Venables et al.

(10) Patent No.: US 8,534,211 B2
(45) Date of Patent: Sep. 17, 2013

(54) VARIABLE GEOMETRY FIN

(75) Inventors: John D. Venables, Monroe, CT (US); Christopher M. Pappas, Saint Leonard, MD (US)

(73) Assignee: Naiad Maritime Group, Inc., Shelton, CT (US)

( * ) Notice: Subject to any disclaimer, the term of this patent is extended or adjusted under 35 U.S.C. 154(b) by 306 days.

(21) Appl. No.: 12/884,970

(22) Filed: Sep. 17, 2010

(65) Prior Publication Data

US 2011/0132246 A1 Jun. 9, 2011

Related U.S. Application Data

(60) Provisional application No. 61/276,949, filed on Sep. 18, 2009.

(51) Int. Cl.
*B63B 39/06* (2006.01)
*B63B 43/04* (2006.01)

(52) U.S. Cl.
USPC ..... 114/126

(58) Field of Classification Search
USPC ..... 114/121, 122, 126, 152, 170, 271, 114/274–290; 244/204, 204.1, 218, 219
See application file for complete search history.

(56) References Cited

U.S. PATENT DOCUMENTS

| | | | | |
|---|---|---|---|---|
| 2,231,226 | A * | 2/1941 | Schwarzmayr | 244/215 |
| 2,979,010 | A | 4/1961 | Braddon et al. | |
| 3,260,232 | A | 7/1966 | Douglas | |
| 3,690,284 | A * | 9/1972 | Van de Stadt | 114/152 |
| 3,867,897 | A * | 2/1975 | Yamamoto | 114/167 |
| 4,460,138 | A * | 7/1984 | Sankrithi | 244/215 |
| 4,667,899 | A * | 5/1987 | Wedertz | 244/49 |
| 4,862,820 | A | 9/1989 | Guezou et al. | |
| 5,127,605 | A * | 7/1992 | Atchison et al. | 244/3.27 |
| 5,193,478 | A * | 3/1993 | Mardikian | 114/285 |
| 5,365,870 | A | 11/1994 | Ehluss | |
| 6,978,728 | B2 | 12/2005 | Koop et al. | |
| 7,451,715 | B2 | 11/2008 | Koop et al. | |

FOREIGN PATENT DOCUMENTS

| | | | |
|---|---|---|---|
| EP | 1577210 | A1 | 9/2005 |
| JP | 63149290 | A * | 6/1988 |

OTHER PUBLICATIONS

International Search Report & Written Opinion of the International Searching Authority; Application No. PCT/US2010/049462; Issued: Jan. 13, 2012; Mailing Date: Jan. 24, 2012; 9 pages.

* cited by examiner

*Primary Examiner* — Ajay Vasudeva
(74) *Attorney, Agent, or Firm* — St. Onge Steward Johnston & Reens LLC

(57) ABSTRACT

A variable geometry fin for use in a ship stabilization system is provided. A stabilization element adapted to extend below the water line of a ship. The stabilization element has a foil body and a trailing edge assembly extending from inside of the foil body. The trailing edge assembly includes an extension body having two opposing surfaces, a trailing edge attached to an end of the extension body, a vortex generator having protrusions and/or recesses on the two opposing surfaces, and at least one support guide located on an outboard side of the extension body. A deploy mechanism is attached to the foil body and the trailing edge assembly. The trailing edge assembly extends rearwardly from the foil body producing an additional surface area.

21 Claims, 5 Drawing Sheets

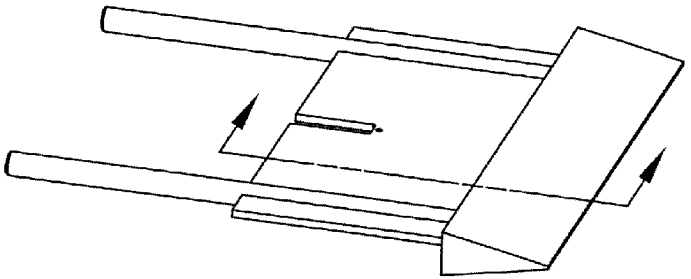
FIGURE 5a
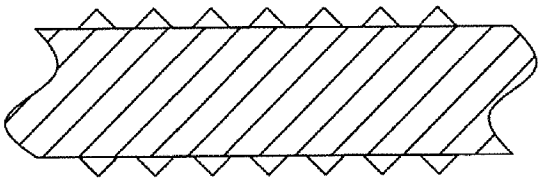
5b
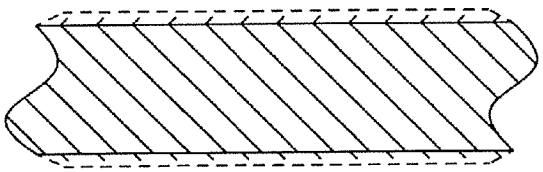
5c
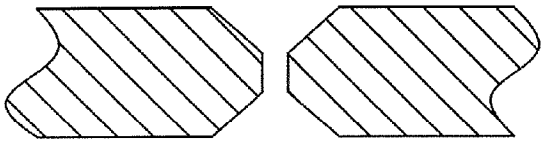
5d
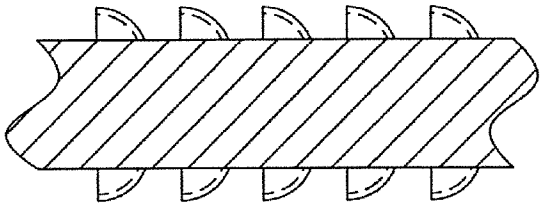
5e
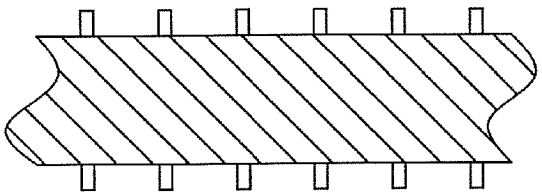
5f
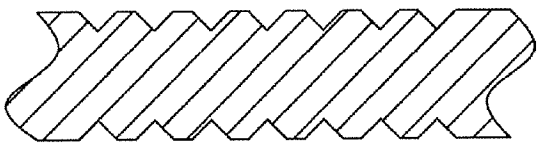
5g

VARIABLE GEOMETRY FIN

CROSS-REFERENCE TO RELATED APPLICATIONS

The present application claims the benefit under 35 U.S.C. §119 (e) of U.S. Provisional Patent Application Ser. No. 61/276,949 filed on Sep. 18, 2009.

FIELD OF THE INVENTION

The present invention relates generally to a system for controlling the roll of a ship, and more specifically, relates to extending or retracting a portion of a stabilizing fin of a ship depending on whether the ship is at rest or making headway.

BACKGROUND OF THE INVENTION

A floating ship has six degrees of freedom, roll, pitch, yaw, heave, surge, and sway. Roll is generally the most objectionable as it is easily magnified by sea conditions, it affects sea keeping, operation of the ship, and the ship's course, and can damage cargo being stored on the ship. It is also unpleasant for passengers and the crew by causing motion induced sickness. All vessels have their own natural roll period depending on hull shape, loading, and other factors. Wave motions initiate this roll and, if the wave encounter frequency is in close synchronization with the vessel's natural period, roll motion may build to uncomfortable or even dangerous proportions. A vessel will naturally exhibit wave-induced roll both while making headway ("underway") and while drifting, holding position or on anchor at zero forward speed ("at rest").

Many types of stabilizing systems have been developed to dampen wave-induced roll motion. The most prevalent type of stabilizing system involves the use actively-controlled underwater fins to generate the forces used to stabilize a vessel making headway. When used underway, fins are rotated about the shaft stock axis presenting an angle to the onrushing water which generates a hydrodynamic lift force.

More recently, active underwater fin stabilizer systems have also been utilized to dampen vessel roll motion while the vessel is at rest (zero forward speed). When used at rest, fins are rotated about the shaft stock axis and act on the surrounding water in such a way, not unlike a paddle, to create a useful force. Fin systems that are designed to operate at zero forward speed are commonly referred to as "stabilization at anchor", "at rest", or "zero speed" systems. Because these stabilizer systems attempt to satisfy the vessel's roll reduction requirements both while underway and at rest, a design compromise exists. A fin planform geometry optimized to suit one requirement (e.g. at rest) will not be well-configured for the other requirement (e.g. underway). Moreover, the fin area required to stabilize a vessel at rest is typically larger (often significantly larger) than the fin area required to stabilize the same vessel underway. The smaller area required for underway stabilization is due to the hydrodynamic benefits which stem from the fin's movement during forward motion through the water. Consequently, a large fin area sized and shaped for at rest stabilization causes significant inefficiencies, including higher total drag and a poor lift-to-drag ratio, when the same shape is also used to satisfy underway stabilization requirements.

Prior art systems, such as U.S. Pat. No. 7,451,715 to Koop et al., have attempted to overcome this problem by introducing a fin stabilization system where the fin has an extension portion that extends the body of the fin; the extension is deployed from inside of the fin itself. However, this fin design suffers from at least one major problem. Since the extension is perfectly flat, there is minimal drag, and it is inefficient at trapping water. This creates an inefficient mechanism of controlling the roll of the ship at rest as the water can readily pass over the extension.

What is desired, therefore, is a variable geometry fin designed to more efficiently adjust the flow of water and readily create a greater amount of drag for a given rotational speed and area, and which facilitates ship stabilization at rest or at slow speeds underway more efficiently, while also allowing for efficient stabilization underway at higher speeds.

SUMMARY OF THE INVENTION

The variable geometry fin is a unique underwater fin system that is variable in area to suit the different area and planform requirements of underway and at rest stabilization. Due to the unique ability of the variable geometry fin to change area in a manner more closely optimized for both needs, the variable geometry fin is much more efficient when used underway than a fin designed for performance at rest, and much more efficient when used at rest than a fin designed for performance underway. For the compromise reasons explained above, a single non-variable area fin is not capable of this result. Moreover, even a variable area fin capable of changing its planform geometry in other ways, for example increasing the effective span of the fin to gain area for use at rest, would not match the superior efficiency, both underway and at rest, of the variable geometry fin of this invention.

A superior feature of the variable geometry fin is that its variable area is deployed in such a way so as to avoid increasing the span of the fin (the outreach dimension of the fin, as measured from the surface of the hull), which remains the same in both the retracted and deployed modes of use. This is a major advantage for a ship since stabilizer fins are protruding hull appendages making them particularly vulnerable to grounding or other impact from floating debris or marine life, which can result in fin damage and loss of use and/or potentially hull damage and associated safety concerns. Once the fin is deployed, the variable geometry fin employs a vortex generator, composed of protrusions and/or detents, and geometrically shaped trailing edge, and a support guide. This creates a recessed area that is capable of trapping, and adjusting the flow of water against the variable geometry fin, which provides a superior roll stabilization system to that of U.S. Pat. No. 7,451,715 to Koop et al., detailed above.

In accordance with a first embodiment of the present invention, a variable geometry fin comprises a stabilization element adapted to extend below the water line and a deploy mechanism. The stabilization element has a foil body and a trailing edge assembly extending from the foil body. The trailing edge assembly includes an extension body having two opposing surfaces, a trailing edge attached to an end of the extension body, a vortex generator having protrusions and/or recesses on the two opposing surfaces, and at least one support guide located on an outboard side of the extension body. The deploy mechanism is attached to the foil body and the trailing edge assembly. The trailing edge assembly extends rearwardly with respect to the foil body producing an additional surface area of the stabilization element.

In some of these embodiments, the trailing edge is shaped as a triangle, a wedge, a knife, a fixed interceptor, or an adjustable interceptor. In some of these embodiments, the deploy mechanism is a mechanical mechanism, an oil-based hydraulic actuator, an oil-based motor, a water-based hydraulic actuator, a water-based motor, an electrical actuator, an electrical motor, a pneumatic actuator, or a pneumatic motor.

In certain of these embodiments, the vortex generator is a through-structure orifice with sharp or angled entry and exit edges, a cup shape, a straight edge, a surface indentation or groove, a saw tooth, or a bonded coating. In certain of these embodiments, the support guide is shaped as a circle, a square, a rectangle, or an I-beam.

In accordance with another embodiment of the present invention, a variable geometry fin comprises a stabilization element adapted to extend below the water line and a deploy mechanism. The stabilization element has a foil body and a trailing edge assembly extending from the foil body. The trailing edge assembly includes an extension body having two opposing surfaces, a trailing edge attached to an end of the extension body, a vortex generator on the two opposing surfaces, and at least one support guide located on an outboard side of the extension body, the support guide deployed when the extension body is deployed. The deploy mechanism is attached to the foil body and the trailing edge assembly. The trailing edge assembly extends rearwardly with respect to the foil body producing an additional surface area of the stabilization element.

In some of these embodiments, the trailing edge is shaped as a triangle, a wedge, a knife, a fixed interceptor, or an adjustable interceptor. In some of these embodiments, the deploy mechanism is a mechanical mechanism, an oil-based hydraulic actuator, an oil-based motor, a water-based hydraulic actuator, a water-based motor, an electrical actuator, an electrical motor, a pneumatic actuator, or a pneumatic motor. In certain of these embodiments, the vortex generator is a through-structure orifice with sharp or angled entry and exit edges, a cup shape, a straight edge, a surface indentation or groove, a saw tooth, or a bonded coating. In certain of these embodiments, the support guide is shaped as a circle, a square, a rectangle, or an I-beam.

In accordance with another embodiment of the present invention, a variable geometry fin comprises a stabilization element adapted to extend below the water line and a deploy mechanism. The stabilization element has a foil body and a trailing edge assembly extending from the foil body. The trailing edge assembly includes an extension body having two opposing surfaces, a trailing edge attached to an end of the extension body, a vortex generator having protrusions and/or recesses located on the two opposing surfaces, and at least one support guide located on an outboard side of the extension body, the support guide deployed when the extension body is deployed. The deploy mechanism is attached to the foil body and the trailing edge assembly. The trailing edge assembly extends rearwardly with respect to the foil body producing an additional surface area of the stabilization element.

In some of these embodiments, the trailing edge is shaped as a triangle, a wedge, a knife, a fixed interceptor, or an adjustable interceptor. In some of these embodiments, the deploy mechanism is a mechanical mechanism, an oil-based hydraulic actuator, an oil-based motor, a water-based hydraulic actuator, a water-based motor, an electrical actuator, an electrical motor, a pneumatic actuator, or a pneumatic motor. In certain of these embodiments, the vortex generator is a through-structure orifice with sharp or angled entry and exit edges, a cup shape, a straight edge, a surface indentation or groove, a saw tooth, or a bonded coating. In certain of these embodiments, the support guide is shaped as a circle, a square, a rectangle, or an I-beam.

In accordance with another embodiment of the present invention, a variable geometry fin comprises a stabilization element adapted to extend below the water line and a deploy mechanism. The stabilization element has a foil body and a trailing edge assembly extending from the foil body. The trailing edge assembly includes an extension body having two opposing surfaces, a trailing edge extending perpendicularly from the extension body forming a recessed area between the trailing edge and the foil body, a vortex generator having protrusions and/or recesses located on the two opposing surfaces, and at least one support guide located on an outboard side of the extension body, the support guide deployed when the extension body is deployed. The deploy mechanism is attached to the foil body and the trailing edge assembly. The trailing edge assembly extends rearwardly with respect to the foil body producing an additional surface area of the stabilization element.

In some of these embodiments, the trailing edge is shaped as a triangle, a wedge, a knife, a fixed interceptor, or an adjustable interceptor. In some of these embodiments, the deploy mechanism is a mechanical mechanism, an oil-based hydraulic actuator, an oil-based motor, a water-based hydraulic actuator, a water-based motor, an electrical actuator, an electrical motor, a pneumatic actuator, or a pneumatic motor. In certain of these embodiments, the vortex generator is a through-structure orifice with sharp or angled entry and exit edges, a cup shape, a straight edge, a surface indentation or groove, a saw tooth, or a bonded coating. In certain of these embodiments, the support guide is shaped as a circle, a square, a rectangle, or an I-beam.

The invention and its particular features and advantage will become more apparent from the following detailed description considered with reference to the accompanying drawings.

BRIEF DESCRIPTION OF THE DRAWINGS

FIG. 5*a*-5*g* is a view of the various surface roughness of a variable geometry fin according to FIG. 1.

FIG. 6-6*e* is a view of the various support guides of a variable geometry fin according to FIG. 1.

FIG. 7*a*-7*f* is a view of the various trailing edge designs of a variable geometry fin according to FIG. 1.

DETAILED DESCRIPTION OF THE INVENTION

The system for controlling the roll of a ship includes a variable geometry fin with an extension capable of increasing the surface area of the fin.

Figure 1:
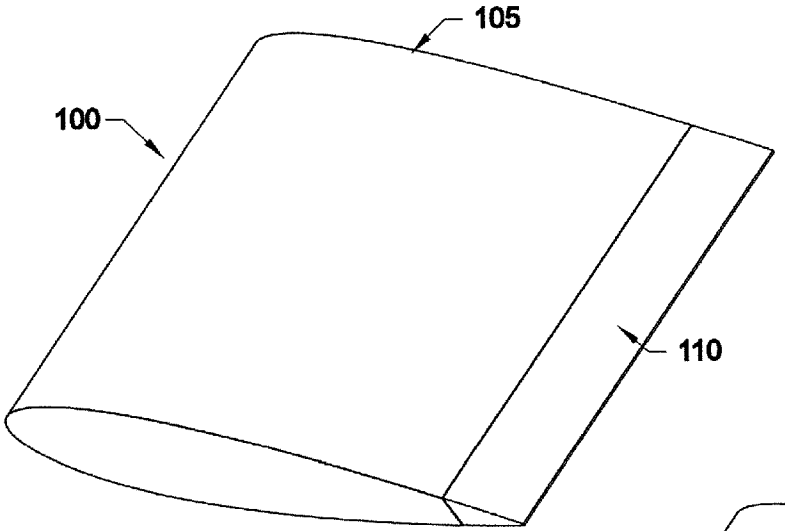
FIG. 1 is a perspective view of a retracted variable geometry fin according to one embodiment of the present invention.
Figure 3:
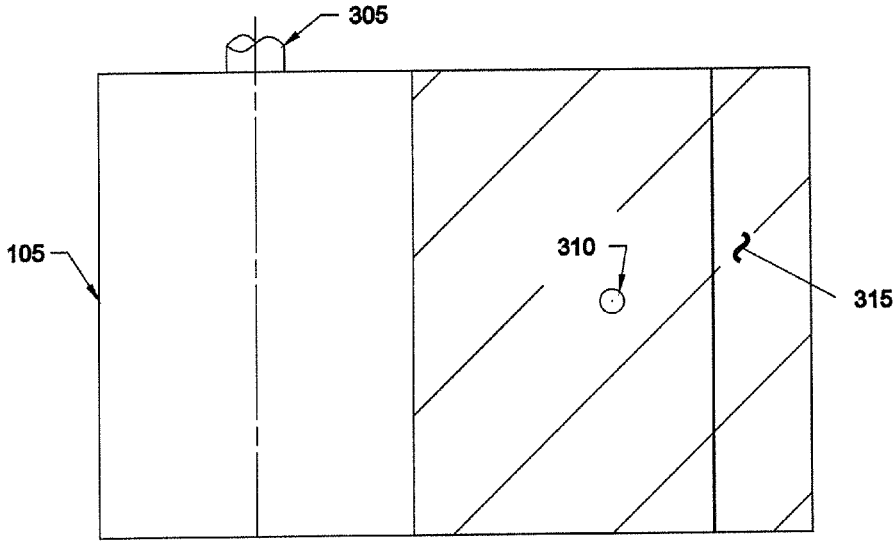
FIG. 3 is a side view of a retracted variable geometry fin according to FIG. 1.
Figure 4:
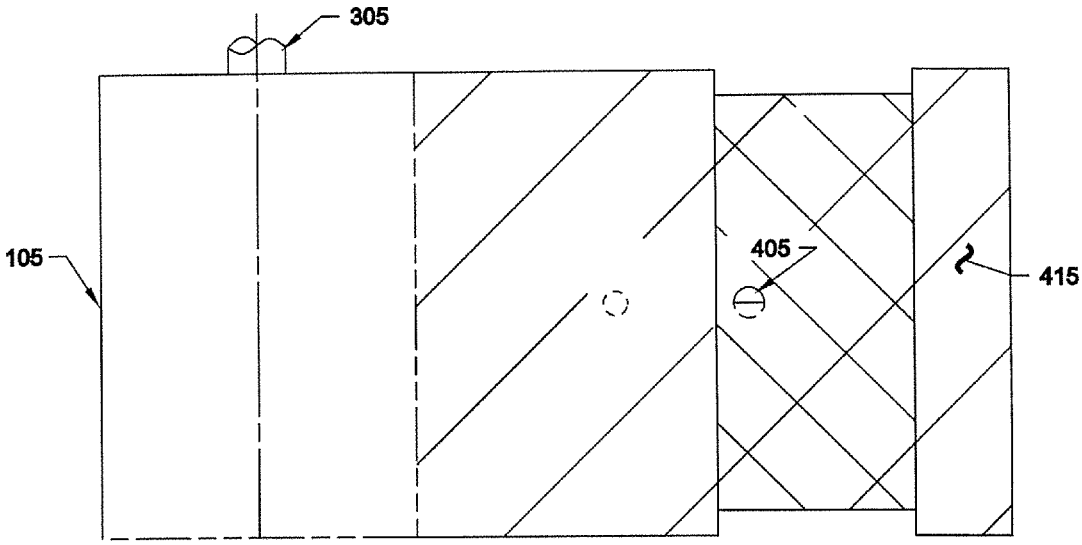
FIG. 4 is a side view of a deployed variable geometry fin according to FIG. 1.

As best seen in FIG. 1, a perspective view of a variable geometry fin, according to the present invention, is shown. Variable geometry fin 100 is rectangular in shape when viewed from the side (as seen in FIGS. 3 and 4 below) and is shaped as an air foil when viewed from the top or bottom. While FIG. 1 shows a variable geometry fin being generally rectangular in shape, the side view of the variable geometry fin may be of any shape to maximize the roll stabilization efficiency of the ship. Furthermore, while the top and bottom view are shaped as an air foil, the cross-section of the variable geometry fin may be of any shape to maximize the roll stabilization efficiency of the ship.

Variable geometry fin 100 has a foil body 105 and a trailing edge 110. When the ship is underway, the trailing edge 110 is retracted into the foil body 105 and does not provide for any extension of the surface area of the variable geometry fin 100. Trailing edge 110 is triangular in shape, forming the point in the air foil shape of variable geometry fin 100. The pointed design allows for a decreased drag against the water as the ship is underway.

Figure 2:
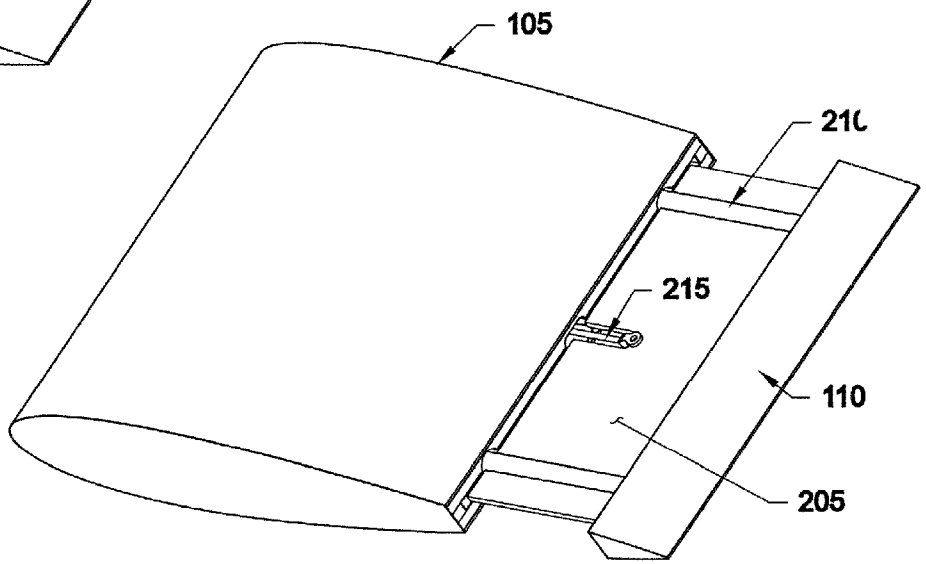
FIG. 2 is a perspective view of a deployed variable geometry fin of one embodiment of the present invention according to FIG. 1

Referring now to FIG. 2, variable geometry fin 100 is shown in an extended position. Trailing edge 110 is extended from the foil body 105 creating a greater surface area using the movable trailing edge assembly 205. In a preferred embodiment, the trailing edge extends aft of the ship, an aft extension provides for an increase in the at-rest stabilization efficiency of variable geometry fin 100. The greater surface area allows for a better roll stabilization while the ship is at rest. Trailing edge 110 can be deployed and retracted using deploy/retract mechanism 215. The deploy/retract mechanism 215 can be operated by a mechanical mechanism, and oil-based or water-based hydraulic actuator or motor, an electrical actuator or motor, or a pneumatic actuator or motor. The deploy/retract mechanism 215 can be operated using only one of the above systems, or the deploy/retract mechanism 215 can be operated by a combination of any of the above systems, or a similar system not specifically designated above.

Movable trailing edge assembly 205 has a support guide 210. Movable trailing edge assembly 205 may have a single support guide 210, or movable trailing edge assembly 205 may have a plurality of support guides 210 depending on the size of the variable geometry fin 100, and the size of the ship being stabilized.

Variable geometry fin 100 may be manually operated by the operator of the ship. The operator may deploy or retract the mechanism using a manually controlled mechanism, or the operator may input commands into a control panel or a computer terminal to deploy or retract the variable geometry fin 100. The variable geometry fin 100 may also be completely computer controlled. The computer may have sole control of the deploy/retract mechanism 215 to extend or retract the trailing edge 110 to the most efficient surface area depending on the speed of the ship. As a computer can more quickly, and accurately compute the most efficient surface area, the variable geometry fin 100 is preferably computer controlled, however a manual override may be used to correct any computer related problems.

Referring now to FIG. 3, a side view of variable geometry fin 100 is shown. As explained above, in a preferred embodiment, the variable geometry fin 100 is shaped as a rectangle when viewed from the side. Variable geometry fin 100 has a fin stock shaft 305 connected to the foil body 105. The fin stock shaft 305 connects the variable geometry fin 100 to the hull of the ship. The fin stock shaft 305 is preferably cylindrical in shape, this allows for rotation of the variable geometry fin 100 about the ship.

When the trailing edge assembly 205 is in the retracted position, the variable geometry fin 100 has a smaller effective surface area exposed to the water, the surface being designated by element 315, and the cross-hatched area of FIGS. 3 and 4. Variable geometry fin 100 has a center of pressure located approximately at a point designated by 310. This creates a moment between point 310 and the axis defined by the fin stock shaft 305.

Referring now to FIG. 4, trailing edge assembly 205 in a deployed position is shown. Effective surface area 415 is larger than surface area 315 as the trailing edge assembly has extended rearwardly, exposing more effective surface area to affect the flow of water. Trailing edge assembly 205 is deployed using deploy mechanism 215 (not shown) and an increased effective surface area is exposed to the water. This is preferably done while the ship is at rest, or while the ship is at low speeds. The increased surface area creates a new center of pressure 405, which creates a new moment between center of pressure 405 and the axis defined by fin stock shaft 305. By shifting the movable trailing assembly 205 directly aft of the foil body 105, the fin planform aspect ratio is reduced; the aspect ratio being the span of the fin divided by the chord. This reduced aspect ratio is highly desired while the ship is at rest. It should be noted, that while FIG. 4 shows only a small addition to the entire surface area, trailing edge assembly 205 may extend to increase the surface area by any amount by use of a telescopic mechanism, or any other known extension mechanism.

The deploy mechanism moves the center of pressure from 310 to 405. This movement of the center of pressure further aft allows greater useful forces to develop during at rest usage for a given slew rate. When the variable geometry fin 100 is rotated while at rest, using fin stock shaft 305, it reacts against the mass of water to generate forces which are transmitted to the fin stock shaft 305 and into the vessel structure allowing a righting moment to be developed in opposition to the vessel's roll motion. Conversely, during underway operation, the reduced fin aspect ratio is not desirable as it reduces the hydrodynamic efficiency of the fin.

While underway, a higher fin aspect ratio produces a higher lift-to-drag ratio, resulting in a more useful lift for a given drag (penalty) or less drag for a given lift. Generally, the surface area required for underway operation is less than the surface area required for at rest operation. During underway operation, the movable trailing edge assembly 205 is retracted into the foil body 105, allowing for a smooth hydrofoil surface and a higher aspect ratio for efficient lift force generation.

Referring now to FIGS. 5*a* through 5*g*, differing textures of the movable trailing edge assembly 205 are shown. The movable trailing edge assembly 205 may be completely smooth on its surface, however, movable trailing edge assembly 205 may also be textured. This texture is used to increase the surface roughness. The added surface roughness creates vortex generators along the surface of the movable trailing edge assembly 205, effectively adding resistance to the variable geometry fin 100, which is beneficial during at rest operation. This surface is fully concealed when movable trailing edge assembly 205 is retracted for use during underway stabilization so as to not affect the underway performance.

Various textured surfaces may be used in the vortex generation, as depicted in FIGS. 5*b* through 5*g*. The textured surface includes, but are not limited to: (5*b*) saw tooth details which generates vortices at various scales, (5*c*) bonded coatings with heavy surface roughness which generates vortices at various scales, (5*d*) through-structure orifices with sharp or angled entry and exit edges to promote flow vortices, (5*e*) cupped details which interrupt flow, trap added mass of water, and generates vortices at various scales, (5*f*) straight edge detail which interrupt flow, trap added mass of water, and generate vortices of various scales, and (5*g*) surface indentations or groves which generate vortices at various scales. All of the above vortex generators provide surfaces which create higher drag, which enhances fin stabilization while at rest. While the above list is exemplary, many other vortex generators may be used that are not listed above.

Figure 6:
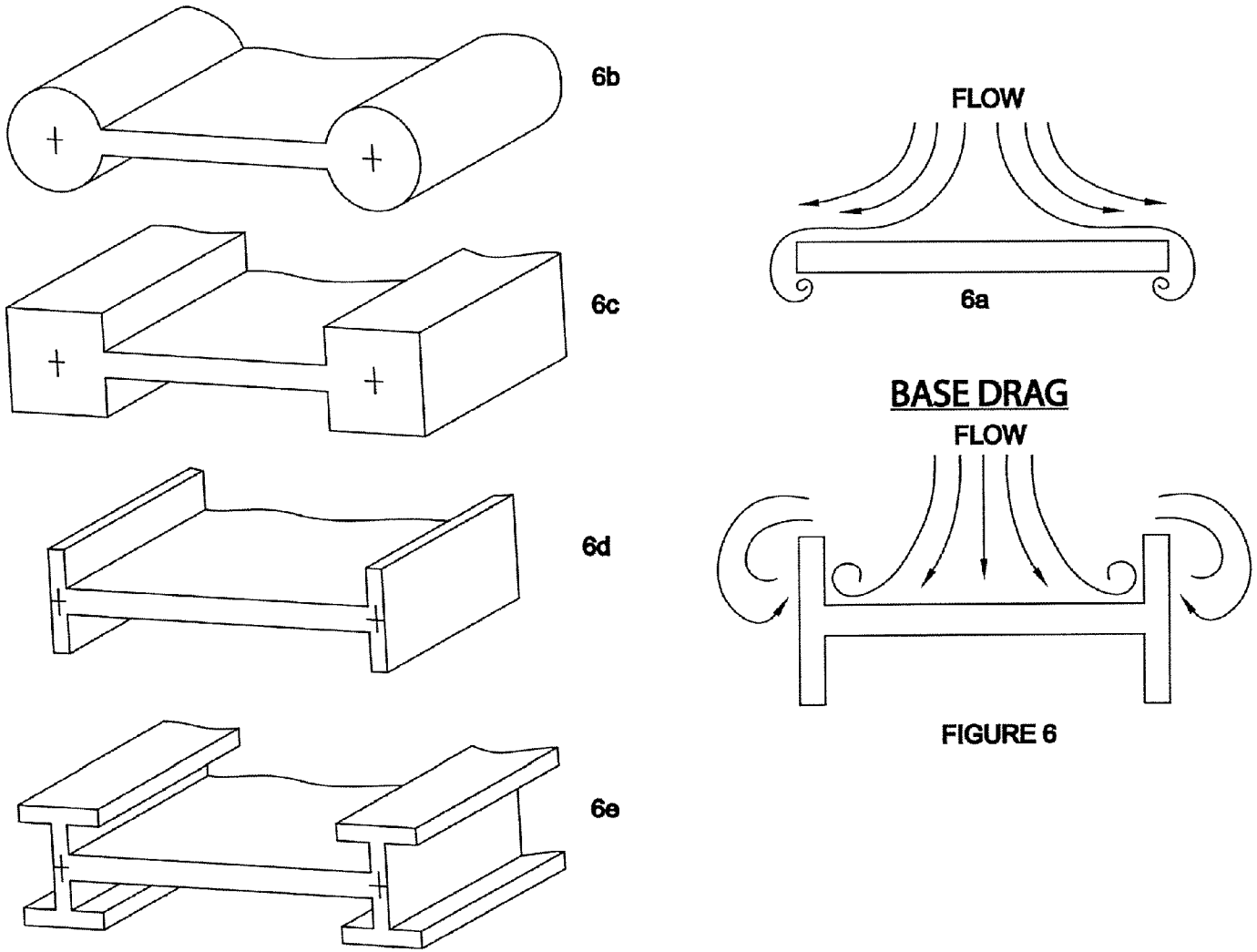
Figure 7A:
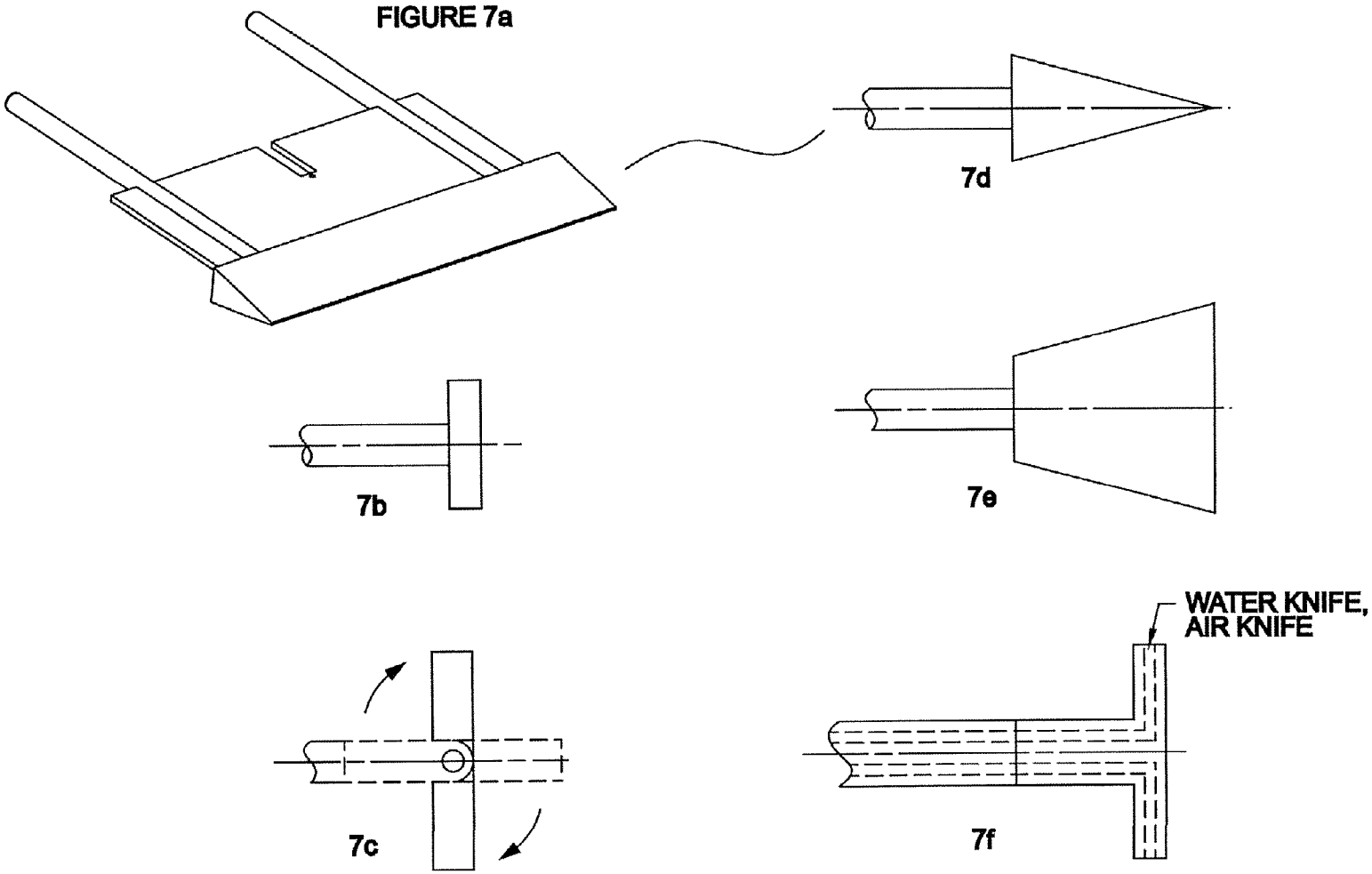

Referring now to FIGS. 6 through 6*e* differing structures of support guide 210 are shown. The support guides are preferably located along the outboard sides of the movable trailing edge assembly 205, however, they can be located at any point on movable trailing edge assembly 205. Without the differing shapes of the support guide 210, an undesirable cross flow is generated, as is evident from FIG. 6*a*. The edge detail of support guide 210 is designed to minimize cross flow from the high to low pressure regions along the sides of variable geometry fin 100. These features are only present when the variable geometry fin 100 is deployed, exposing the support guide 210. A reduced cross flow is desired, as is evident from FIG. 6. The various shapes of support guide 210 include, but are not limited to (6*b*) circular, (6*c*) square, (6*d*) rectangular, (6*e*) I-beam.

Referring now to FIG. 7*a* through 7*f*, differing designs for the trailing edge 110 are shown. Trailing edge 110 is stepped to provide increased turbulent flow during at rest operation. The turbulence increases the flow resistance over the back edge from the high to low pressure side of the fin, enhancing performance. The stepped design also traps a portion of flow which creates an added mass volume of water providing additional forces used for at rest operation, improving performance of the variable geometry fin 100. The various shapes of the trailing edge 100 include, but are not limited to, (7*b*) a fixed interceptor plate, (7*c*) an adjustable flap/interceptor, (7*d*) standard v-shaped, (7*e*) wedge shaped, or (7*f*) water injection or air injection knife design.

The unique design and configuration of the variable geometry fin allows at rest stabilization fin area and planform geometry (low aspect ratio) efficiency combined with an efficient (higher aspect ratio) underway fin. Because the underway fin shape and section is not compromised, the variable geometry fin is suitable for an extremely wide range of fin section profiles, including but not limited to NACA sections, IfS sections, Schilling sections, Tail Wedge and HSVA sections, and other custom profile sections.

It would be appreciated by those skilled in the art that various changes and modifications can be made to the illustrated embodiment without departing from the spirit of the present invention. All such modifications and changes are intended to be covered hereby.

What is claimed is:

1. A variable geometry fin for use in a ship stabilization system comprising:

a stabilization element adapted to extend below a water line of said ship, said stabilization element having a foil body and a trailing edge assembly extending from inside of said foil body, wherein said trailing edge assembly includes:

an extension body having two opposing surfaces, a trailing edge attached to an end of said extension body, a vortex generator on said two opposing surfaces of said extension body said vortex generator having at least one of protrusion extending from and recess formed in said two opposing surfaces, and at least one support guide located on an outboard side of said extension body; and a deploy mechanism attached to said foil body and said trailing edge assembly;

wherein said trailing edge assembly is extendable rearwardly with respect to said foil body to produce an additional surface area of said stabilization element, and wherein said trailing edge is stepped on said two opposing surfaces to provide increased turbulent flow when said trailing edge assembly is extended during at rest operation and to trap a portion of flow which creates an added mass volume of water providing additional forces used for at rest operation.

2. The variable geometry fin of claim 1, wherein said trailing edge is shaped as one of at least a triangle, a wedge, a knife, a fixed interceptor plate, and an adjustable interceptor plate.

3. The variable geometry fin of claim 1, wherein said deploy mechanism includes one of at least a mechanical mechanism, an oil-based hydraulic actuator, an oil-based motor, a water-based hydraulic actuator, a water-based motor, an electrical actuator, an electrical motor, a pneumatic actuator, and a pneumatic motor.

4. The variable geometry fin of claim 1, wherein said vortex generator is one of at least a through-structure orifice with sharp or angled entry and exit edges, a cup shape, a straight edge, a surface indentation or groove, a saw tooth, and a bonded coating.

5. The variable geometry fin of claim 1, wherein said support guide is shaped as one of at least a circle, a square, a rectangle, and an I-beam.

6. A variable geometry fin for use in a ship stabilization system comprising:

a stabilization element adapted to extend below a water line of said ship, said stabilization element having foil body and a trailing edge assembly extending from inside of said foil body;

wherein said trailing edge assembly includes:

an extension body having two opposing surfaces, a trailing edge attached to an end of said extension body, a vortex generator on said two opposing surfaces, and at least one support guide located on an outboard side of said extension body, said support guide deployed when extension body is extended; and a deploy mechanism attached to said foil body and said trailing edge assembly;

wherein said trailing edge assembly is extendable rearwardly from said foil body to produce an additional surface area of said stabilization element, and wherein said trailing edge is stepped on said two opposing surfaces to provide increased turbulent flow when said trailing edge assembly is extended during at rest operation and to trap a portion of flow which creates an added mass volume of water providing additional forces used for at rest operation.

7. The variable geometry fin of claim 6, wherein said deploy mechanism includes one of at least a mechanical mechanism, an oil-based hydraulic actuator, an oil-based motor, a water-based hydraulic actuator, a water-based motor, an electrical actuator, an electrical motor, a pneumatic actuator, and a pneumatic motor.

8. The variable geometry fin of claim 6, wherein said support guide is shaped as one of at least a circle, a square, a rectangle, and an I-beam.

9. The variable geometry fin of claim 6, wherein said vortex generator is one of at least a through-structure orifice with sharp or angled entry and exit edges, a cup shape, a straight edge, a surface indentation or groove, a saw tooth, and a bonded coating.

10. The variable geometry fin of claim 6, wherein said trailing edge is shaped as one of at least a triangle, a wedge, a knife, a fixed interceptor plate, and an adjustable interceptor plate.

11. A variable geometry fin for use in a ship stabilization system comprising:

a stabilization element adapted to extend below a water line of said ship, said stabilization element having foil body and a trailing edge assembly extending from inside of said foil body, wherein said trailing edge assembly includes:

an extension body having two opposing surfaces, a trailing edge attached to an end of said extension body, a vortex generator on said two opposing surfaces of said extension body said vortex generator having at least one of protrusion extending from and recess formed in said two opposing surfaces, and at least one support guide located on an outboard side of said extension body; and a deploy mechanism attached to said foil body and said trailing edge assembly;

wherein said trailing edge assembly is extendable rearwardly from said foil body to produce an additional surface area of said stabilization element, and wherein said trailing edge is stepped on said two opposing surfaces to provide increased turbulent flow when said trailing edge assembly is extended during at rest operation and to trap a portion of flow which creates an added mass volume of water providing additional forces used for at rest operation.

12. The variable geometry fin of claim 11, wherein said deploy mechanism includes one of at least a mechanical mechanism, an oil-based hydraulic actuator, an oil-based motor, a water-based hydraulic actuator, a water-based motor, an electrical actuator, an electrical motor, a pneumatic actuator, and a pneumatic motor.

13. The variable geometry fin of claim 11, wherein said support guide is shaped as one of at least a circle, a square, a rectangle, and an I-beam.

14. The variable geometry fin of claim 11, wherein said vortex generator is one of at least a through-structure orifice with sharp or angled entry and exit edges, a cup shape, a straight edge, a surface indentation or groove, a saw tooth, and a bonded coating.

15. The variable geometry fin of claim 11, wherein said trailing edge is shaped as one of at least a triangle, a wedge, a knife, a fixed interceptor plate, and an adjustable interceptor plate.

16. A variable geometry fin for use in a ship stabilization system comprising:

a stabilization element adapted to extend below a water line of said ship, said stabilization element having foil body and a trailing edge assembly extending from inside of said foil body, wherein said trailing edge assembly includes:

an extension body having two opposing surfaces, a trailing edge attached to an end of said extension body, said trailing edge extending perpendicularly from said extension body forming a recessed area between said trailing edge and said foil body, a vortex generator on said two opposing surfaces of said extension body, and at least one support guide located on an outboard side of said extension body; and a deploy mechanism attached to said foil body and said trailing edge assembly;

wherein said trailing edge assembly is extendable rearwardly from said foil body to produce an additional surface area of said stabilization element, and wherein said trailing edge is stepped on said two opposing surfaces to provide increased turbulent flow when said trailing edge assembly is extended during at rest operation and to trap a portion of flow which creates an added mass volume of water providing additional forces used for at rest operation.

17. The variable geometry fin of claim 16, wherein said deploy mechanism includes one of at least a mechanical mechanism, an oil-based hydraulic actuator, an oil-based motor, a water-based hydraulic actuator, a water-based motor, an electrical actuator, an electrical motor, a pneumatic actuator, and a pneumatic motor.

18. The variable geometry fin of claim 16, wherein said support guide is shaped as one of at least a circle, a square, a rectangle, and an I-beam.

19. The variable geometry fin of claim 16 wherein said vortex generator is one of at least a through-structure orifice with sharp or angled entry and exit edges, a cup shape, a straight edge, a surface indentation or groove, a saw tooth, and a bonded coating.

20. The variable geometry fin of claim 16, wherein said trailing edge is shaped as one of at least a triangle, a wedge, a knife, a fixed interceptor plate, and an adjustable interceptor plate.

21. The variable geometry fin of claim 16 wherein said at least one support guide is located inside said stabilization element along an outboard side of said extension body.

* * * * *